US006464220B1

(12) United States Patent
Tsai

(10) Patent No.: US 6,464,220 B1
(45) Date of Patent: Oct. 15, 2002

(54) RETRACTABLE ROTATING ROD FOR FOOTBALL TABLE

(76) Inventor: Lore Tsai, No. 22, Lane 20 Zichiang Street, Taichung (TW)

( * ) Notice: Subject to any disclaimer, the term of this patent is extended or adjusted under 35 U.S.C. 154(b) by 0 days.

(21) Appl. No.: 09/852,643

(22) Filed: May 11, 2001

(51) Int. Cl.[7] ..... A63F 7/06
(52) U.S. Cl. ..... 273/108.52
(58) Field of Search ..... 273/108.51, 108.52, 273/108.54, 108.55, 108.56, 108.1, 108.21, 108.31, 108.32, 119 R, 129 W, 129 V

(56) References Cited

U.S. PATENT DOCUMENTS 1,934,381 A * 11/1933 Slosson
4,065,128 A * 12/1977 Gomori
4,078,797 A * 3/1978 Bergee
4,382,598 A * 5/1983 McCloud
5,071,137 A * 12/1991 McCloud
5,072,880 A * 12/1991 McCloud
5,326,102 A * 7/1994 Chang
6,027,251 A * 2/2000 Tsai

FOREIGN PATENT DOCUMENTS

| | | |
|---|---|---|
| BE | 499374 | * 3/1950 |
| CH | 334675 | * 1/1959 |
| GB | 1333073 | * 10/1973 |

* cited by examiner

*Primary Examiner*—Sebastiano Passaniti
(74) *Attorney, Agent, or Firm*—Troxell Law Office PLLC

(57) ABSTRACT

A retractable rotating rod for football table wherein a plurality of rotating rods connected between two long sides of the football table. Each rotating rod comprises a circular inner tube and a polygonal outer tube in which the inner tube is rotatably and movably received in the outer tube. Two blocks are connected between the outer periphery of the inner tube and the inner periphery of the outer tube. The rear end of the inner tube is fixed to the long side of the table and the front end of the outer tube extends through the other long side of the table so as to be held. A plurality of players each have an engaging hole for the outer tube passing therethrough. A plurality of bolts respectively extend through the players and connected to a angle of the outer tube.

4 Claims, 7 Drawing Sheets

Piror Art

Piror Art

Piror Art

RETRACTABLE ROTATING ROD FOR FOOTBALL TABLE

FIELD OF THE INVENTION

The present invention relates to a football table and the rotating rods of the football table include an outer tube and an inner tube retractably received in the outer tube so that the rotating rods are operated smoothly.

BACKGROUND OF THE INVENTION

A conventional football table 10 is shown in FIG. 1, the two long sides 12 of the table 10 have a plurality of parallel rotatable rods 14 and each rod 14 has players 16 connected thereto. A ball on the table 10 is kicked by the players 16 when rotating the rods 14.

The conventional rods 14 have a fixed length and are wider than the table 10 so that they are able to be moved in a direction of the short sides of the table 10 and move the positions of the players 16. However, when moving the rods 14 by pushing the handles 141 of the rods 14, the rear ends 142 of the rods 14 are pushed away from the table 10 and could hit the controllers or persons who stand beside the table 10.

To improve the shortcoming, another conventional structure is shown in FIGS. 2 and 3 and includes an inner tube 22 and an outer tube 24 in which the inner tube 22 is received. The rear end of the inner tube 22 is fixedly connected to a long side 26 of the table and the front end of the outer tube 24 extends through the other long side 26 of the table so that the controllers may hold the outer tubes 24. A plurality of players 27 are connected to the outer tubes 24 and the top of each player 27 is screwed a long bolt 28 downward for being connected to the outer tube 24. When the controllers push or pull the outer tubes 24 along the inner tubes 22, the players 27 are moved and the players 27 kick the ball when rotating the outer tubes 24. By this assembly, the inner tubes 22 will not protrude from the table and hit the controllers.

However, the inner tubes 22 and the outer tubes 24 are thin and circular shaped and there is a tiny gap between the inner tube 22 and the outer tube 24, so that the long bolts 28 often extend into the inner tubes 22 when connecting the players 27 to the outer tubes 24. This will affect the smoothness of the operation of the outer tube 24 movable on the inner tube 22.

Besides, the circular shaped tubes have less structural strength so that the outer tubes tend to be deformed when impacting with objects.

Furthermore, the players are mounted to the outer tubes by a circular hole in the players so that the players have to be fixed with the outer tubes by bolts. However, only one bolt provides a small contact area and the players are easily loosened.

SUMMARY OF THE INVENTION

The object of the present invention is to provide a retractable rotating rod and a larger gap is defined between the outer tube and the inner tube so as to prevent the bolt from contacting the inner tubes when connecting the players on the outer tubes.

Another object of the present invention is to provide a retractable rotating rod for a football table wherein the rotating rod has better structural strength.

Yet another object of the present invention is to provide a retractable rotating rod for a football table wherein the players and the rotating rods are firmly connected with each other so that the players will not loose.

The present invention will be best understood from the following description and accompanying drawings which show, for purposes of illustration only, two preferred embodiments in accordance with the present invention.

DETAILED DESCRIPTION OF THE PREFERRED EMBODIMENT

Figure 1:
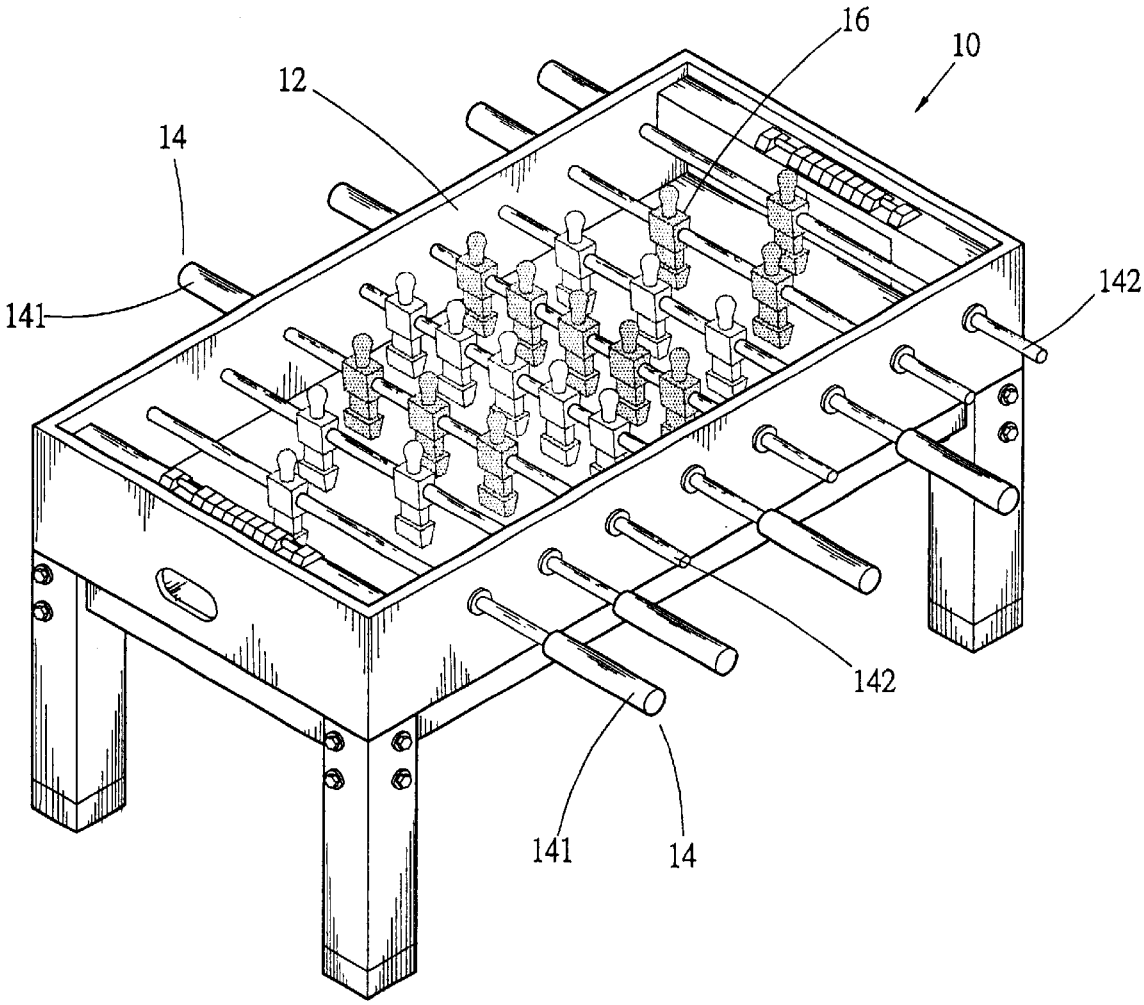
FIG. 1 is a perspective view to show a conventional football table.
Figure 2:
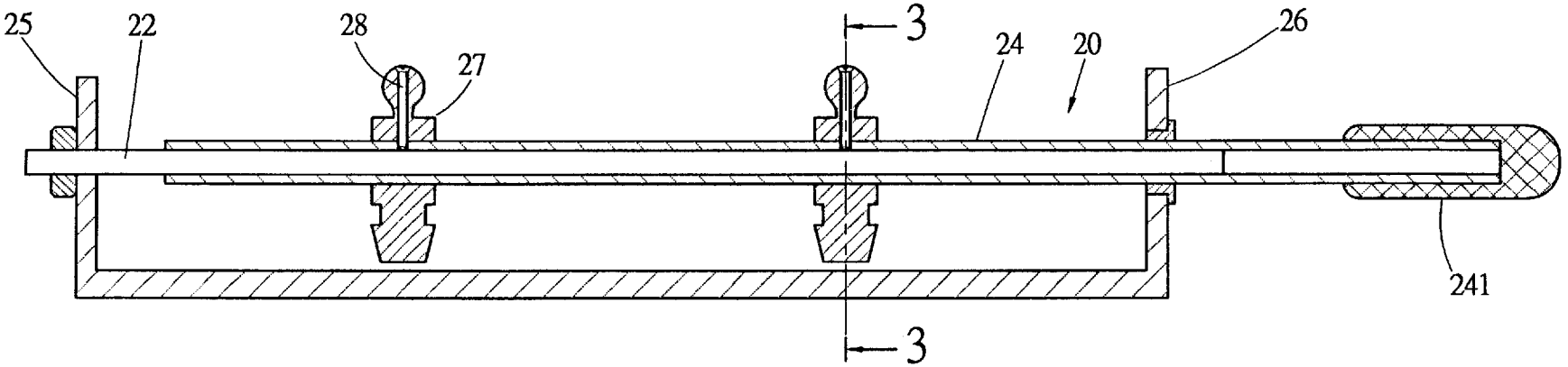
FIG. 2 is a side cross sectional view to show another conventional football table.
Figure 3:
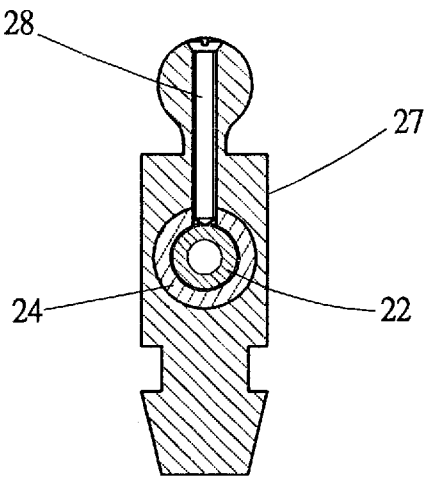
FIG. 3 is a sectional view taken along line 3—3 of FIG. 2.
Figure 4:
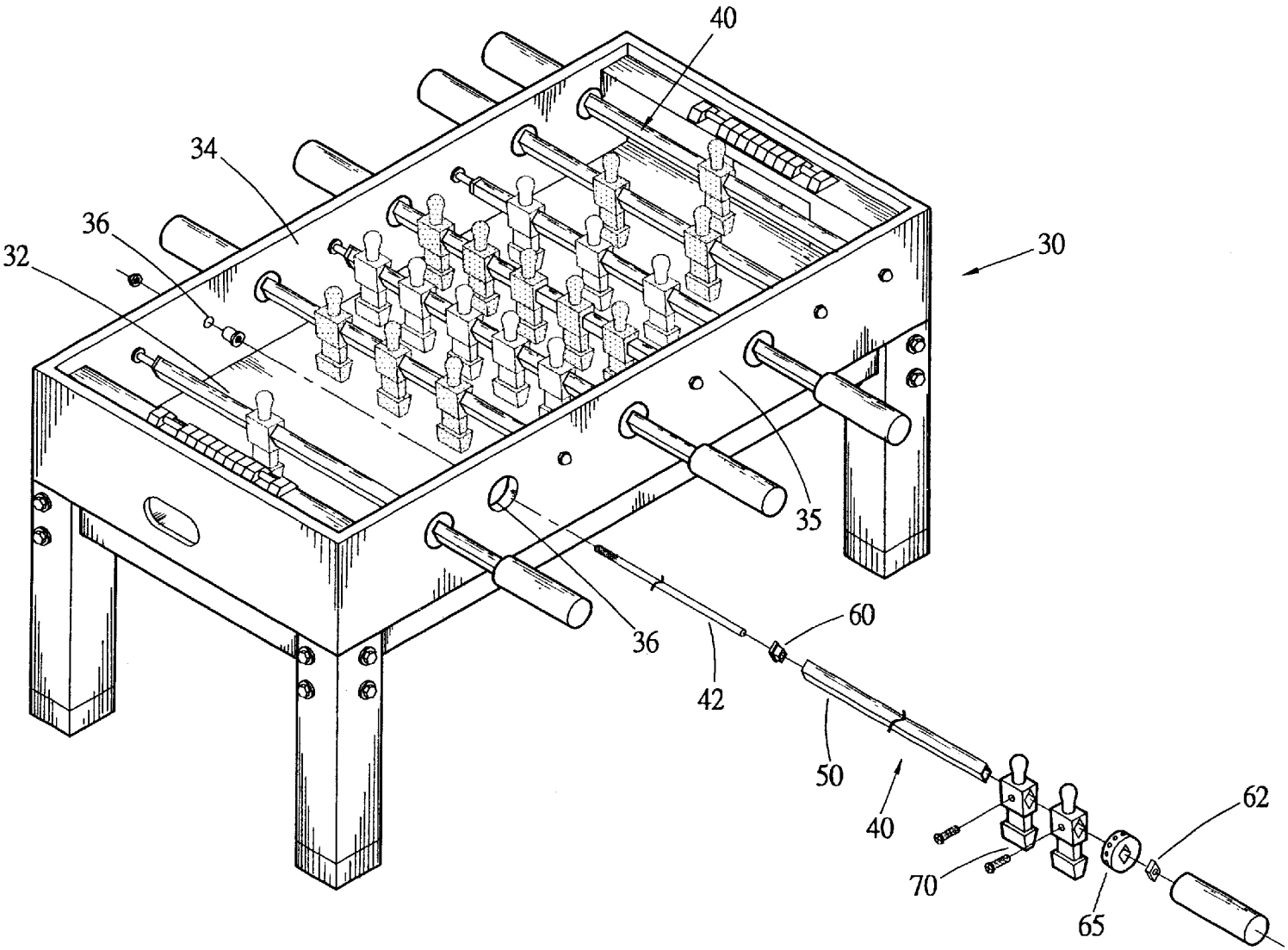
FIG. 4 is an exploded view to show the football table of the present invention.
Figure 5:
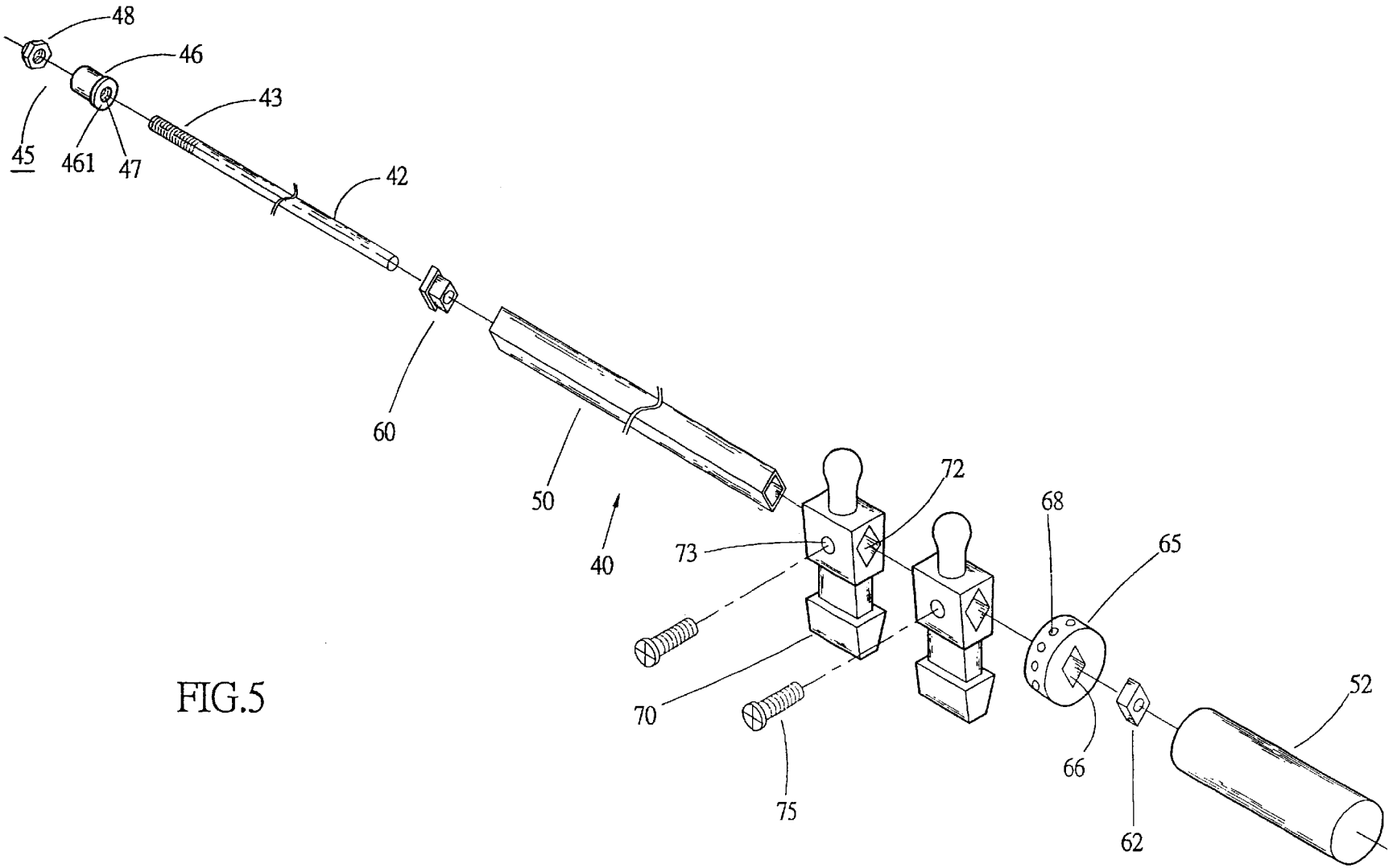
FIG. 5 is an exploded view to show the player and the rotating rod of the present invention.

Referring to FIGS. 4 to 7, a first preferred embodiment of the rotating rod of the present invention is connected to a football table wherein a recessed play area 32 is defined in a top of the table 30.

Figure 6:
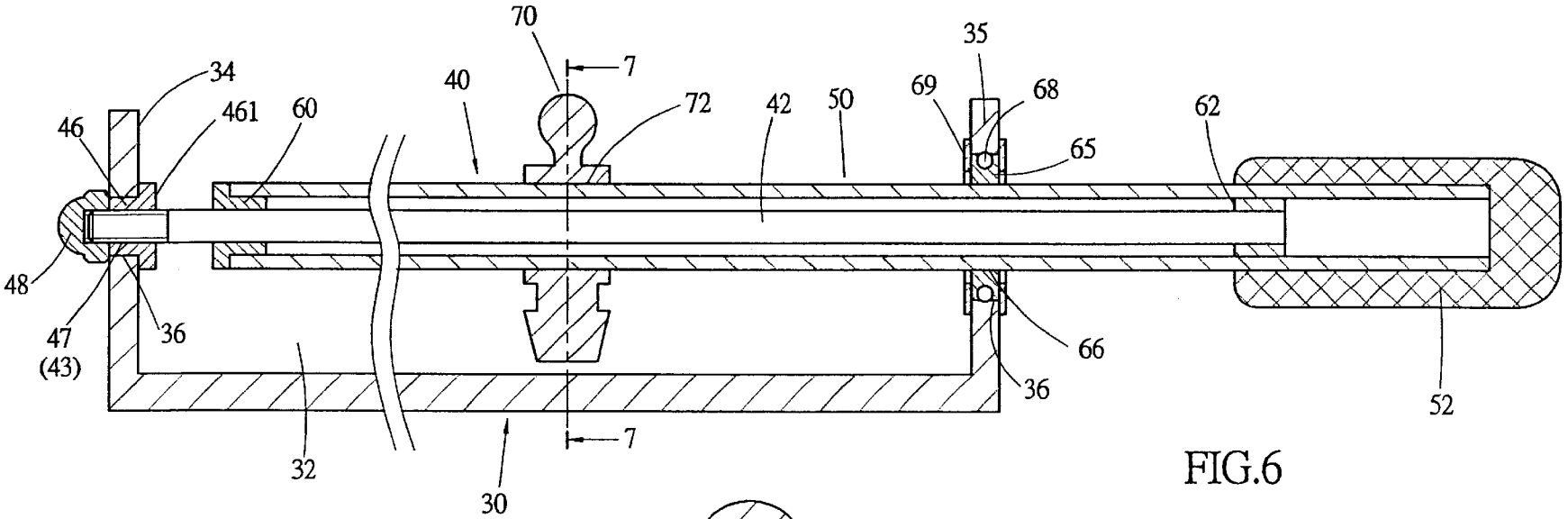
FIG. 6 is a sectional view taken along the axis direction of a rotating rod of FIG. 4.

A plurality of rotating rods 40 are connected between holes 36 defined in two long sides 34, 35 of the table in parallel with each other. Each rotating rod 40 includes:

A circular shaped inner tube 42 has a threaded section 43 on the rear end thereof. A fixing member 45 is used to fix the threaded section 43 to the table and includes a sleeve 46 and a nut. The sleeve 46 has a threaded passage 47 so as to be connected to the threaded section 43, and the sleeve 46 together with the threaded end of the inner tube 42 are inserted in a hole 36 in one of the long sides 34 as shown in FIG. 6. The rear end of the inner tube 42 protrudes from the long side and the flange 461 of the sleeve 46 contacts an inside of the long side 34. The nut 48 is connected to the rear end of the inner tube and contacts an outside of the long side 34 so as to fix the rear end of the inner tube 42 to the long side 34.

An outer tube 50 has a quadrate cross section and the inner tube 42 is received in the outer tube 50 so that the outer tube 50 is able to rotate and move about the inner tube 42. The front end of the outer tube 50 and the inner tube 42 extend through the other long side 35 of the table and the front end of the outer tube 50 extends out from the inner tube 42 so that the controllers may hold the front end of the outer tube 50.

Two quadrate blocks 60 and 62 each have a circular hole, the block 60 is located in the inner surface of the rear end of the outer tube 50 and the block 62 is located in the outer surface of the front end of the inner tube 42 so that the inner tube 42 and the outer tube 50 are positioned with each other.

A ring-shaped bearing 65 having a quadrate hole 66 is received in the hole 36 in the long side 35. A plurality of rollers 68 are embedded in the outer periphery of the bearing 65 so as to reduce rolling friction. Each of the holes 36 in the long side 35 has two rings 69 respectively connected to an inner side and an outer side of the long side 35 as shown in FIG. 6 so as to retain the bearing 65. The outer tube extends through the quadrate hole 66 in the bearing 65.

A plurality of players 70 each has a quadrate engaging hole 72 defined in a mediate section thereof for the outer tube 50 passing therethrough.

Figure 7:
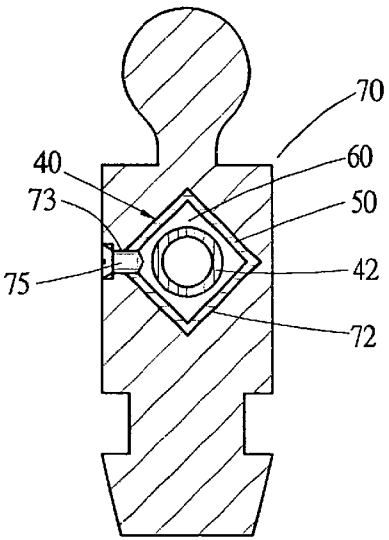
FIG. 7 is a sectional view taken along line 7—7 of FIG. 6.

A plurality of bolts 75 respectively extend through holes 73 in the players 70 and are connected at a corner of the outer tubes 50 so as to fix the players 70 on the outer tube 50. As shown in FIG. 7, there is enough space between the inner tube 42 and the corner of the outer tube 50 so that the bolts 75 will not contact the inner tubes 42.

When in use, the controllers hold the handle 52 on the front end of the outer tube 50 and move the outer tube 50 along the inner tube 42 to adjust the positions of the players 70. The outer tube 50 may rotate about the inner tube 42 to kick a ball in the play area 32. The bearing 65 is rotated with the outer tube 50 so as to reduce friction between the outer tube 50 and the table.

Figure 8:
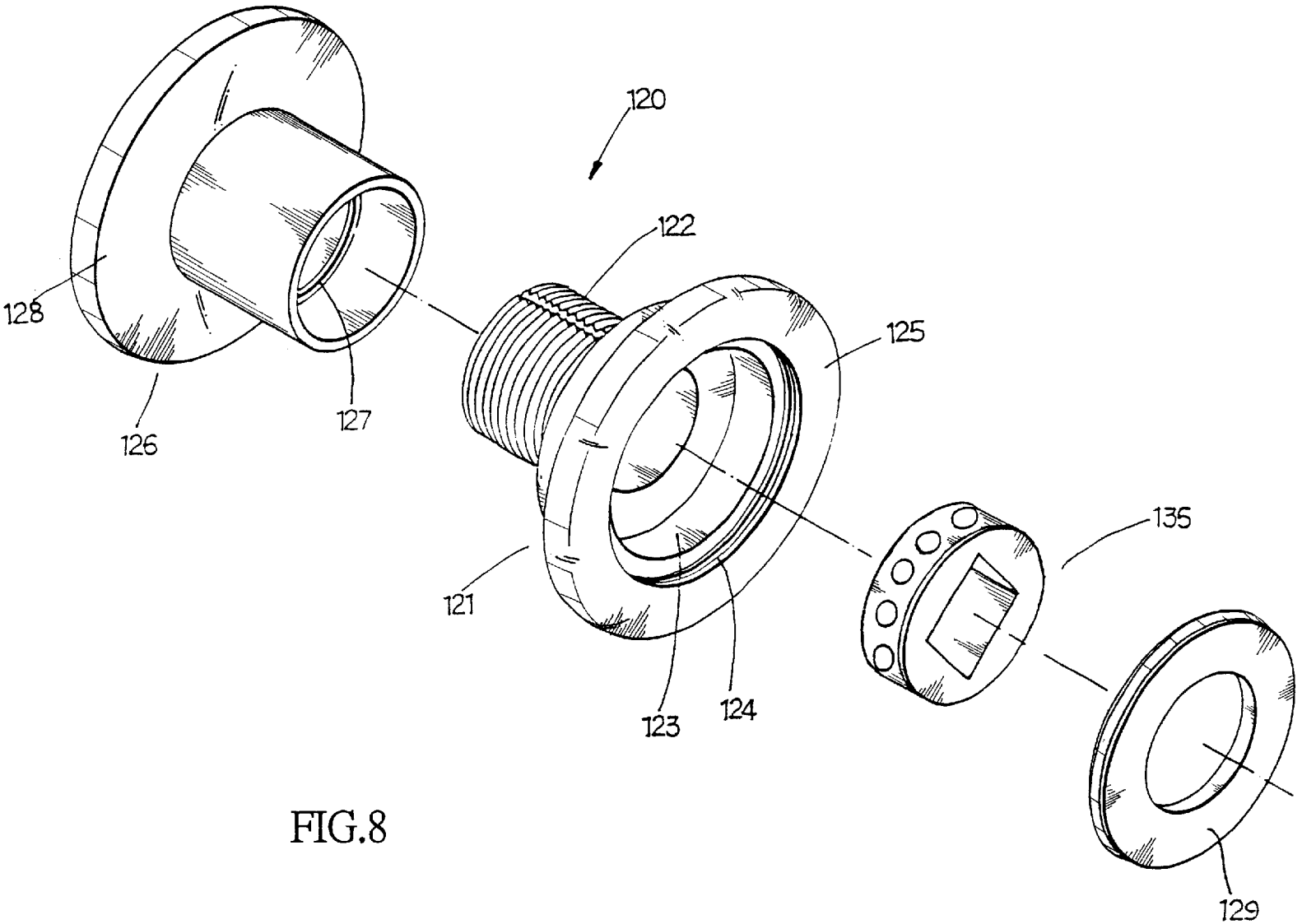
FIG. 8 is an exploded view to show a support assembly of the rotating rod of another embodiment of the football table of the present invention.
Figure 9:
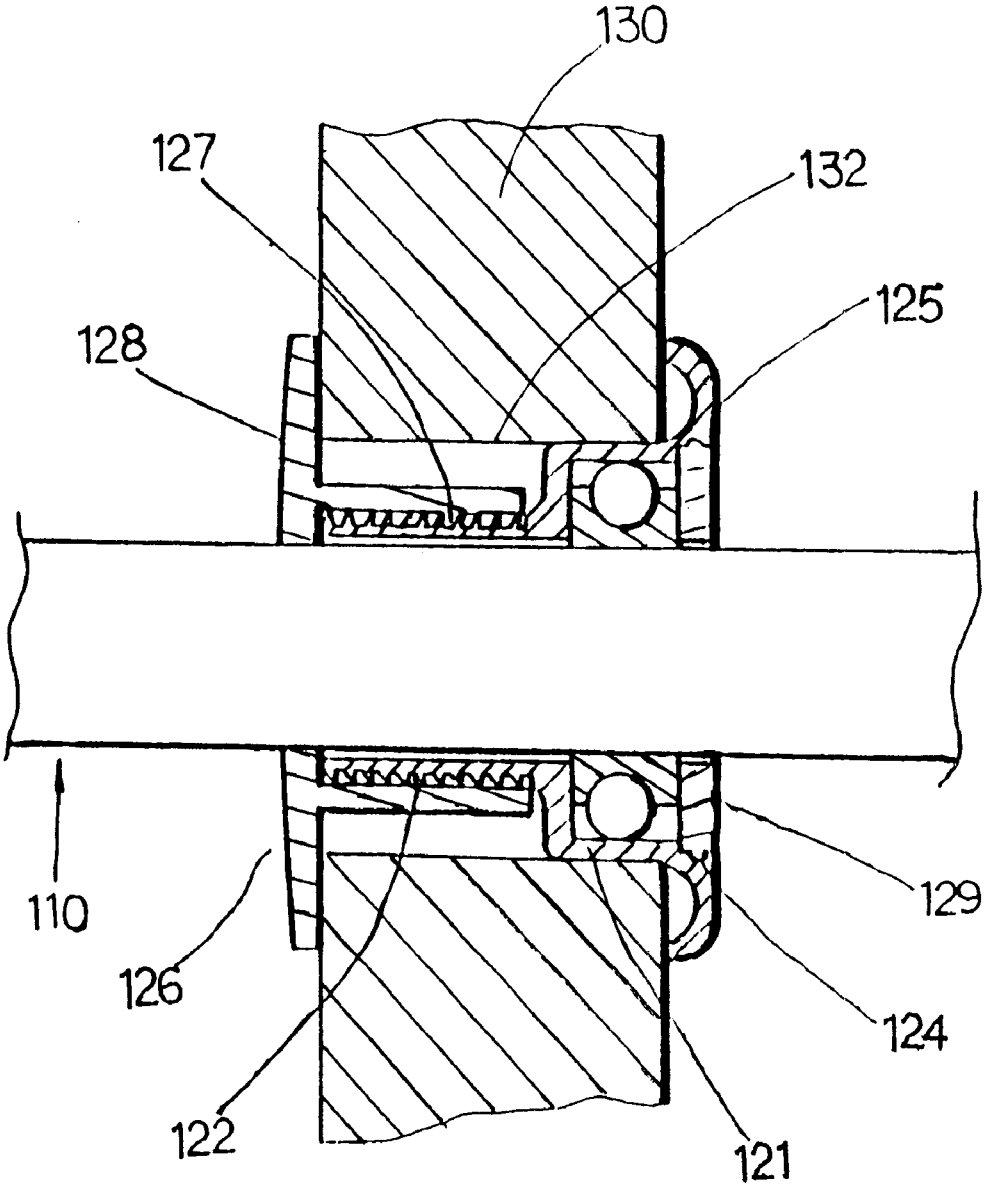
FIG. 9 is a cross sectional view to show the connection of the assembly as shown in FIG. 8.

FIGS. 8 and 9 show another embodiment of the invention wherein the rotating rod 110 further includes a support assembly 120 having a tubular male member 121 and a tubular female member 126. The male member 121 has a plurality of toothed rings 122 defined in an outer periphery thereof and a recess 123 is defined in an end of the male member 121. The female member 126 has an engaging ring 127 defined in an inner periphery thereof. A ring-shaped cap 129 is engaged with the recess 123 and the groove 124 of the inner periphery of the male member 121.

When assembling, a bearing 135 is received in the recess 123 and the ring-shaped cap 129 is then engaged with the recess 123 to retain the bearing 135. The male member 121 and the female member 126 are respectively inserted in the hole 312 from two sides of the long side 130. The engaging ring 127 is engaged with a toothed ring 122 to connect the male member 121 and the female member 126, and the two flanges 125, 128 of the male member 121 and the female member 126 respectively contact the two sides of the long side 130. By this assembly, the bearing is fixed in the long side and the rotating rod 110 then pass through the bearing. In this embodiment, no threaded member is required to connect the bearing in the long side of the table.

The features of the present invention are that there is enough space between the inner tube and the outer tube so as to prevent bolts from contacting the inner tube. Therefore, the outer tube is smoothly moved on the inner tube.

The shape of the outer tube is polygonal and has better structural strength which effectively avoids from deformation of the outer tube.

There are multiple contact points between the engaging hole of the player and the outer tube and these contact points are able to bear large torque so that the player will not be loosened.

What is claimed is:

1. A retractable rotating rod for a football table wherein a plurality of rotating rods are connected between two long sides of a football table, each rotating rod comprising:

a circular inner tube;

an outer tube having a polygonal cross section with said inner tube rotatably and movably received in said outer tube, there being space between said inner tube and a maximum outer diameter of said outer tube;

at least two blocks each having a polygonal outer periphery and a circular hole defined therethrough, said blocks received between an outer periphery of said inner tube and an inner periphery of said outer tube, so that the inner tube and outer tube are positioned with respect to each other;

a bearing having a hole matched with said outer periphery of said outer tube and engaged with a first long side of said table;

a rear end of said inner tube extending out from a rear end of said outer tube and connected to a second long side of said table; a front end of said outer tube extending out from a front end of said inner tube and engaging with the hole of said bearing and extending through the first long side of said table for holding;

a plurality of players each have an engaging hole for said outer tube passing therethrough, said engaging hole being shaped to match with said outer periphery of said outer tube, and a plurality of bolts respectively extending through said players and threadedly connected to engage the maximum outer diameter of said outer tube.

2. The rotating rod as claimed in claim 1 wherein said bolt is threadedly connected to a corner of said outer tube.

3. The rotating rod as claimed in claim 1 wherein each of said rotating rods comprises a support assembly having a tubular male member and a tubular female member, said male member having a plurality of toothed rings defined in an outer periphery thereof and a recess defined in an end of said male member, a flange extending outwardly from said end of said male member; said female member having an engaging ring defined in an inner periphery thereof; a flange extending outwardly from one end of said female member; a ring-shaped cap engaged with said recess, said male member and said female member respectively inserted in said first long side of said table and said engaging ring engaged with said toothed ring, said two flanges respectively contacting two sides of said long side, said bearing received in said recess.

4. The rotating rod as claimed in claim 1 wherein one of said at least two support members is connected to the rear end of said outer tube and the other one of said at least two support members is connected to the front end of said inner tube.

* * * * *